United States Patent [19]

Catterfeld

[11] 4,307,995

[45] Dec. 29, 1981

[54] VANELESS MULTISTAGE PUMP

[75] Inventor: Fritz C. Catterfeld, Canoga Park, Calif.

[73] Assignee: Rockwell International Corporation, El Segundo, Calif.

[21] Appl. No.: 117,750

[22] Filed: Feb. 1, 1980

[51] Int. Cl.[3] ..... F04D 29/44

[52] U.S. Cl. ..... 415/199.1; 415/206

[58] Field of Search ..... 415/199.1, 205, 206

[56] References Cited

U.S. PATENT DOCUMENTS

| | | | |
|---|---|---|---|
| 773,953 | 11/1904 | Maginot | 415/205 X |
| 1,917,029 | 7/1933 | Good | 415/205 X |
| 3,756,738 | 9/1973 | Lee | 415/199.1 X |
| 4,025,225 | 5/1977 | Durant | 415/199.1 X |

FOREIGN PATENT DOCUMENTS

| | | | |
|---|---|---|---|
| 612664 | 11/1948 | United Kingdom | 415/199.1 |

*Primary Examiner*—Leonard E. Smith

*Attorney, Agent, or Firm*—H. F. Hamann; Robert M. Sperry

[57] ABSTRACT

A multistage, vaneless centrifugal pump having an input stage, an output stage, and a plurality of intermediate stages with each of said intermediate stages comprising a divider plate serving to separate successive stages, and a center plate having a recess formed in the rear surface of said center plate serving as a vaneless radial diffuser and having a recess formed in the front surface of said center plate serving to receive fluid from a preceding stage and to guide said fluid in a helically converging path to be delivered to the input of an impeller.

1 Claim, 11 Drawing Figures

Fig. 2
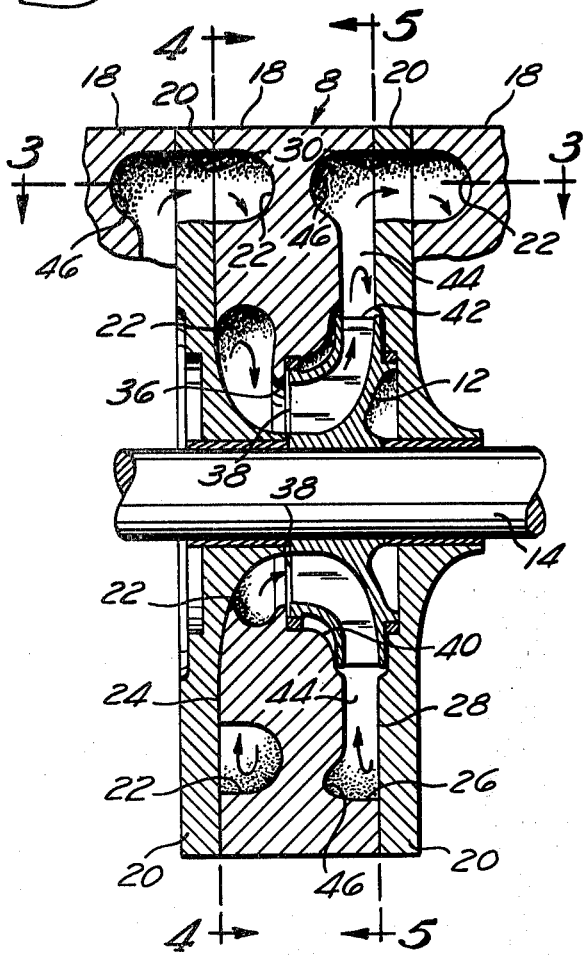
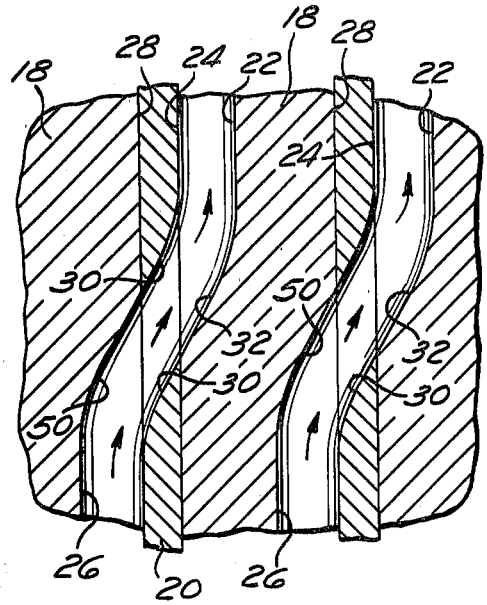
Fig. 3
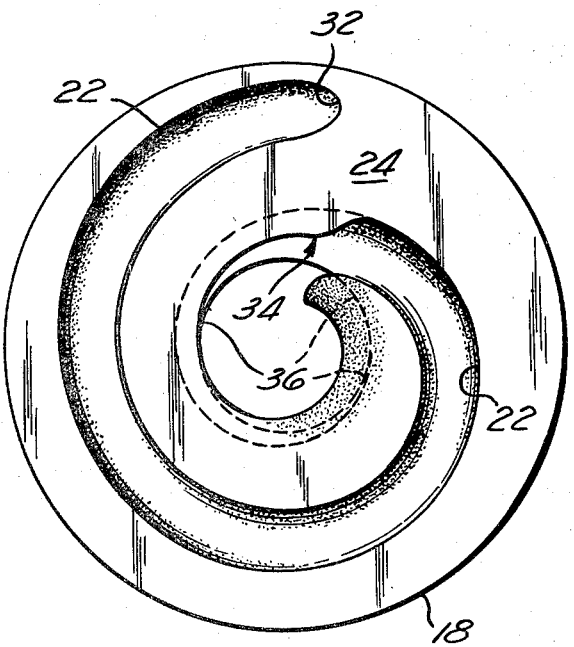
Fig. 4
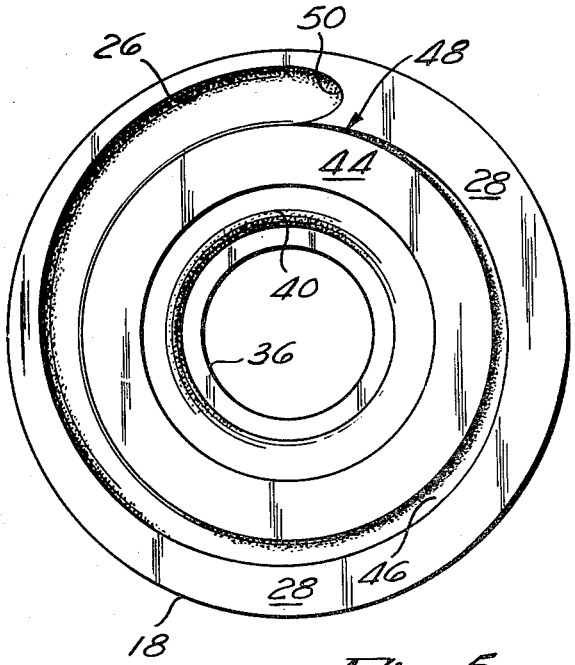
Fig. 5

VANELESS MULTISTAGE PUMP

BACKGROUND OF THE INVENTION

1. Field of the Invention

This invention relates to rotating machinery, and is particularly directed to vaneless, multistage, centrifugal pumps and the like having a radial diffuser and a spiral crossover between stages.

2. Description of Prior Art

In centrifugal pumps, it is customary to provide a diffuser portion which receives fluid flow exiting the impeller and serves to convert the flow velocity, imparted by impeller, into increased pressure by allowing the flow cross section to increase. In multistage pumps, it is necessay to divert the direction of fluid flow in the diffuser in order to guide the flow to the impeller inlet of the next stage. Where pure fluids are being transported, these directional changes can be quite abrupt and vanes can be provided to assist in diverting the flow direction. However, when highly abrasive materials, such as coal slurry, are being transported, the flow direction must be changed very gradually in order to avoid destructive erosion of the pump housing. Also, flow directing vanes become eroded so rapidly that they are of questionable value. In order to avoid these problems in transporting highly abrasive materials, it has been customary to employ conduits external to the pump housing for changing the flow direction from the output of one stage to the inlet of the next. Such conduits are substantially cheaper and easier to replace than the pump housing and, hence, have served to reduce the cost of such pumps and the "down time" involved in making repairs. On the other hand, such external conduits are less efficient and are extremely bulky, especially where the slurry is to be transported at high pressures, and are susceptable to damage from external sources.

BRIEF SUMMARY AND OBJECTS OF INVENTION

These disadvantages of the prior art are overcome with the present invention, and a multistage, centrifugal pump is provided which employs vaneless diffusers and spiral passageways to direct fluid flow from the output of one stage to the input of the next stage internally of the pump housing in a way that minimizes erosion.

Accordingly, it is an object of the present invention to provide an improved multistage, centrifugal pump for transporting highly abrasive material, such as coal slurry.

Another object of the present invention is to provide a multistage, centrifugal pump having means internal of the pump housing for directing fluid flow from the output of one stage to the input of the next stage.

An additional object of the present invention is to provide a multistage, centrifugal pump having vaneless means internal of the pump housing for directing fluid flow from the output of one stage to the input of the next stage.

These and other objects and features of the present invention will be apparent from the following detailed description taken with reference to the figures of the accompanying drawings.

BRIEF DESCRIPTION OF DRAWINGS

FIG. 2 is an enlarged view of the interior components of the pump of FIG. 1;

FIG. 3 is an enlarged section of the pump of FIG. 1, taken on the line 3—3 of FIG. 2, showing the spiral input;

FIG. 4 is a left-side elevation of the center plate of the pump of FIG. 1, viewed as shown by arrows 4—4 of FIG. 2, showing the radial diffuser;

FIG. 5 is a right-side elevation of the center plate of the pump of FIG. 1, viewed as shown by arrows 5—5 of FIG. 2;

DETAILED DESCRIPTION OF THE PREFERRED EMBODIMENTS

Figure 1:
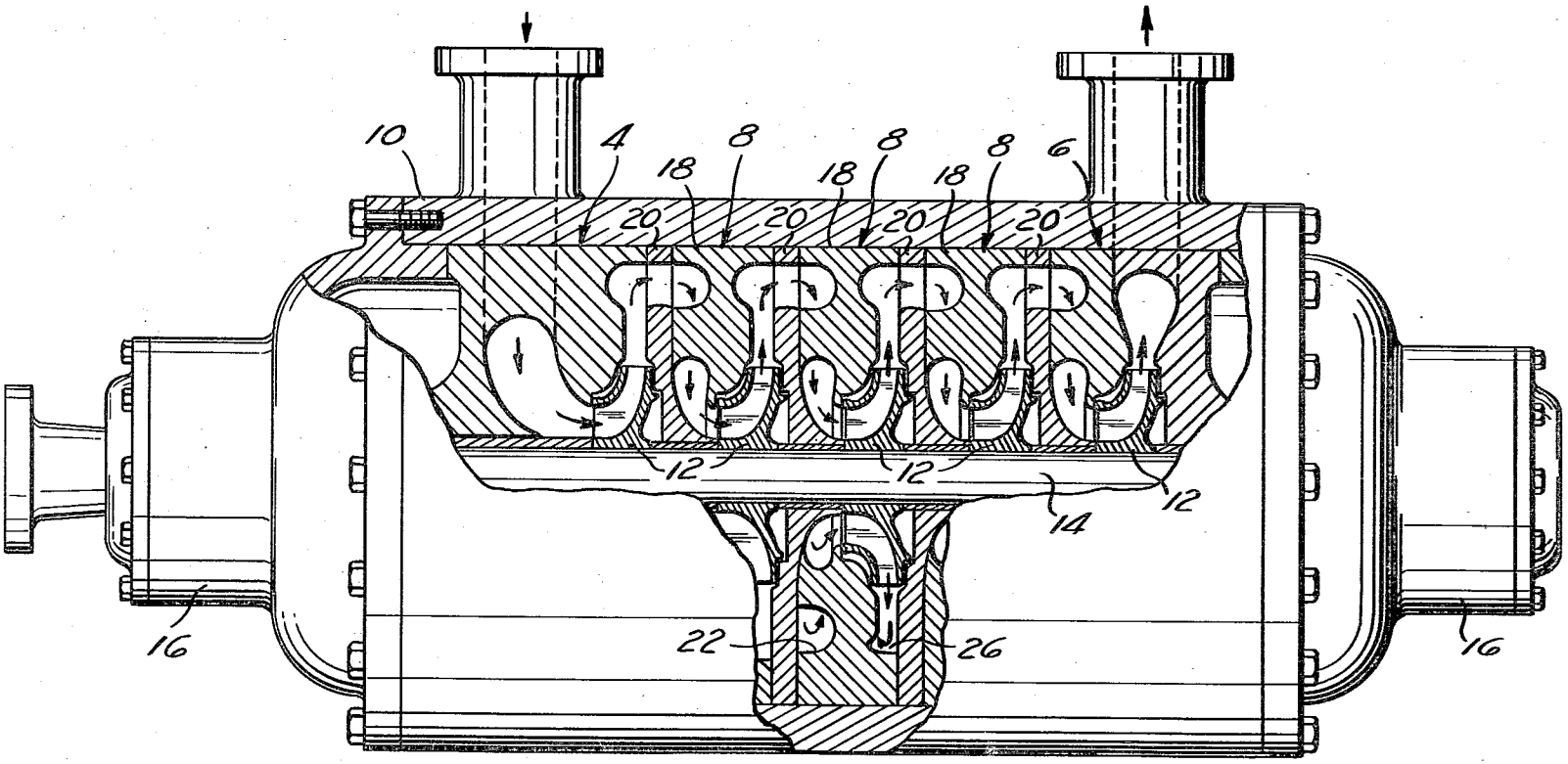
FIG. 1 is a front elevation of a multistage, centrifugal pump embodying the present invention with portions of the housing shown broken away to expose the interior thereof.

In that form of the present invention chosen for purposes of illustration, FIG. 1 shows a multistage, centrifugal pump, indicated generally at 2; having an input stage, indicated generally at 4; an output stage, indicated generally at 6; and a plurality of intermediate stages, indicated generally at 8; contained within a suitable housing 10. Each of the stages 4, 6 and 8 includes a respective impeller 12 mounted for rotation by a common drive shaft 14 which is journaled in suitable bearings 16 and driven by a suitable power source (not shown).

As best seen in FIG. 2, each of the intermediate stages 8 comprises a center plate 18, an impeller 12, and a divider plate 20. The center plate 18 has a first recess 22 formed in its front surface 24 which cooperates with the adjacent divider plate 20 to form a spiral input channel for delivering fluid to the impeller 12, as best seen in FIG. 4. Similarly, the center plate 18 has a second recess 26 formed in its rear surface 28 which cooperates with the adjacent divider plate 20 to form a vaneless, radial diffuser for fluid exiting the impeller 12, as best seen in FIG. 5. Each of the divider plates 20 is formed with an inclined oval opening 30 extending therethrough, as seen in FIGS. 2 and 3 to couple the fluid flow exiting the vaneless diffuser 44 of one stage 8 to the spiral input 22 of the next stage 8.

As shown in FIGS. 2, 3, and 4, the outer end 32 of the spiral input recess 22 is configured to receive fluid from the radial diffuser 26 and collector 46 of the preceding stage 8 and to guide the fluid helically inward for approximately one revolution at substantially constant cross-sectional area. At about the point indicated by arrow 34, the spiral input recess 22 is formed to gradually direct the fluid flow axially away from front surface 24, while it continues the helical path approximately another revolution, and becomes a substantially circular opening 36 which corresponds in size to the inlet 38 of impeller 12, as best seen in FIGS. 2, 4, 8, 9, 10 and 11.

The rear surface 28 of the center plate 18 has a central portion 40 configured to accommodate the impeller 12, as best seen in FIGS. 2 and 5. Adjacent the impeller outlet 42, recess 26 continues radially for some distance to form the radial diffuser region 44. Thereafter, the collector is formed by a groove 46 which begins at about the point indicated by arrow 48 and extends through approximately 360°, becoming gradually wider and deeper as it progresses, and terminating in a curved portion 50 which serves to divert the fluid flow to the opening 30 in the adjacent divider plate 20, as best seen in FIGS. 2, 3, and 5.

Figure 7:
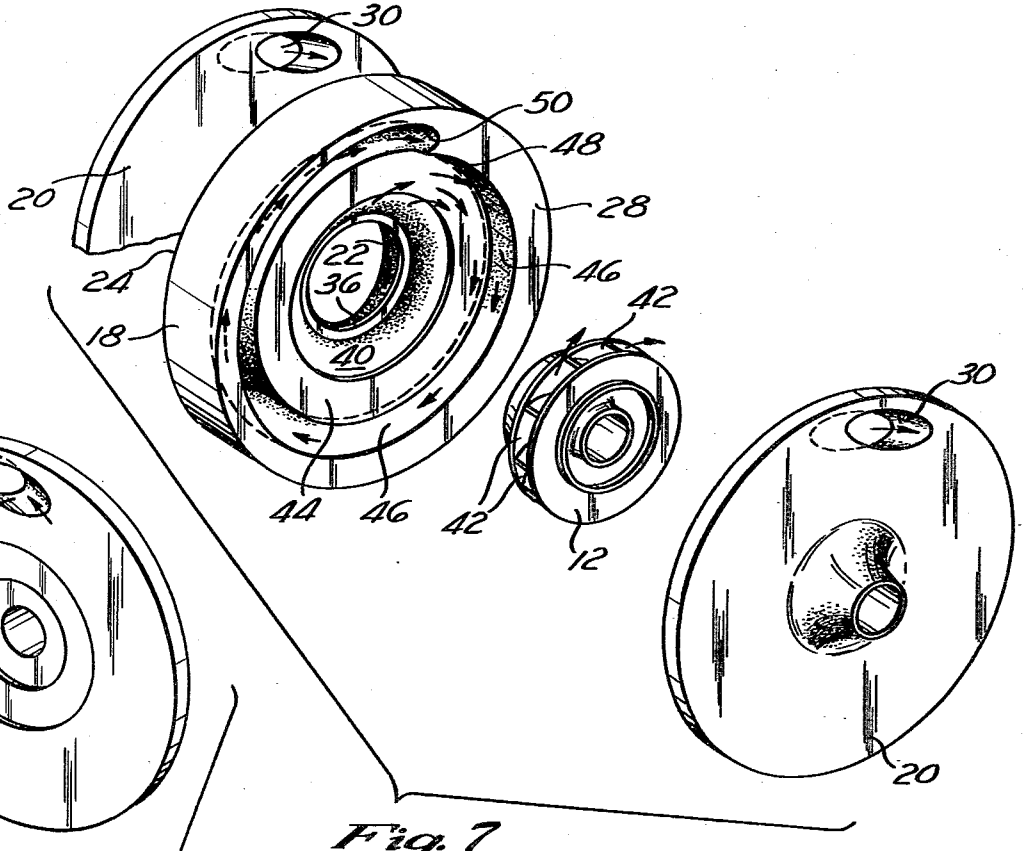
FIG. 7 is an exploded perspective of the center plate, impeller and divider plate of one stage of the pump of FIG. 1, showing the radial diffuser.
Figure 6:
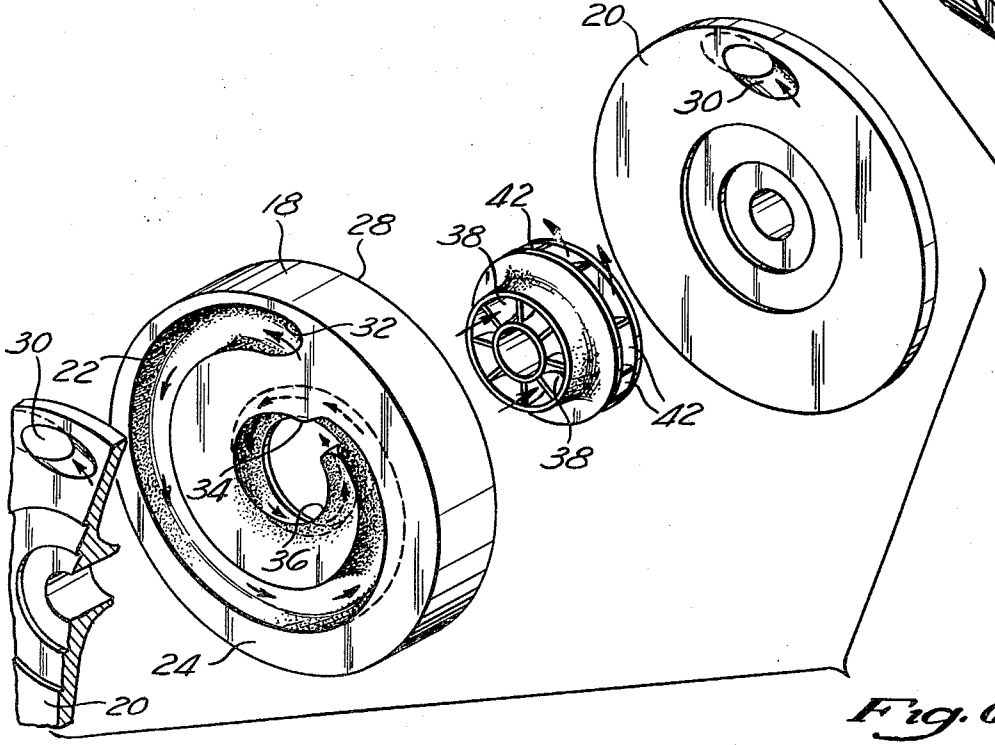
FIG. 6 is an exploded perspective of the center plate, impeller and divider plate of one stage of the pump of FIG. 1, showing the spiral input to the impeller.
Figure 8:
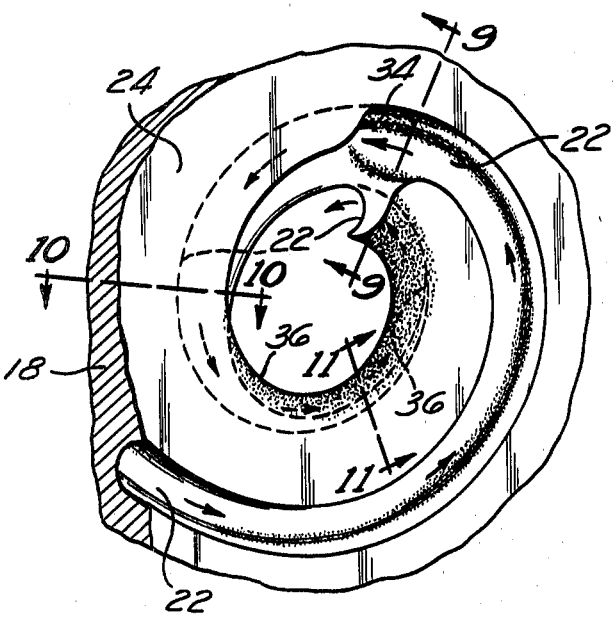
FIG. 8 is an enlarged detail of the spiral input of FIG. 3.
Figure 9:
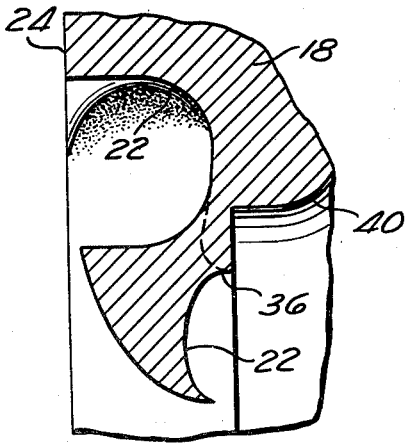
FIGS. 9, 10 and 11 are transverse sections of the center plate of one stage of the pump of FIG. 1, taken, respectively, on the lines 9—9, 10—10, and 11—11 of FIG. 8.
Figure 10:
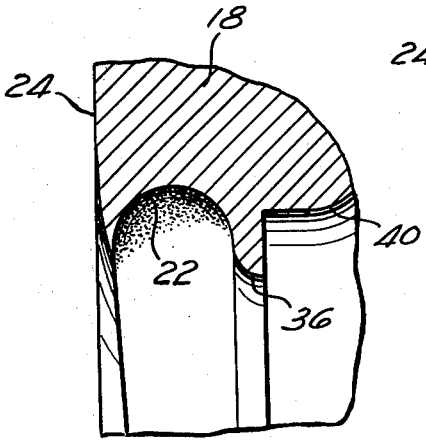
Figure 11:
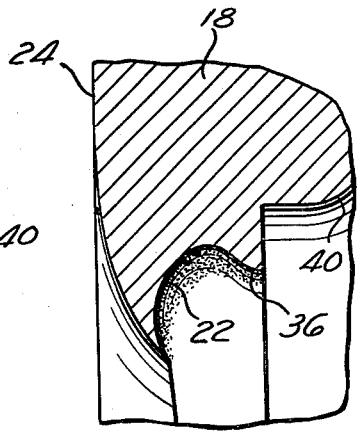

In use, as best seen in FIGS. 6 and 7, fluid flow from a preceding stage of the pump 2 is delivered, via opening 30 of divider plate 20 into recess 22 in front surface 24 of center plate 18. Recess 22 guides the fluid flow, through a substantially constant cross-sectional area, along a helically converging path and diverts the flow axially to be delivered to the input 38 of impeller 12. Driven by drive shaft 14, the impeller 12 accelerates the fluid flow radially through the impeller outlet 42. Upon exiting the impeller 12, the fluid flow is allows to diffuse radially through portion 44 of the diffuser recess 26. Thereafter, the fluid flow continues to diffuse along collector groove 46 until it is delivered through the oval opening 30 of the adjacent divider plate 20 to the next stage 8 of the pump 2. Thus, the flow volume is allowed to diffuse and the flow is guided through the pump with no abrupt changes of direction and without requiring the use of vanes. Consequently, erosion of the pump components is minimized.

Since the center plates 18, divider plates 20, and impellers 12 of each of the intermediate stages are identical, it will be obvious that the corresponding parts will be interchangeable. Accordingly, the inventory of replacement parts may be minimized and maintenance of the pump 2 is greatly simplified.

Obviously, numerous variations and modifications can be made without departing from the present invention. Accordingly, it should be clearly understood that the form of the present invention described above and shown in the accompanying drawings is illustrative only, and is not intended to limit the scope of the invention.

What is claimed and desired to be secured by Letters Patent of the United States is:

1. In a centrifugal, multistage pump having an input state, an outlet stage and a plurality of intermediate stages, the improvement wherein each of said intermediate stages comprises:

an impeller;

a divider plate serving to separate said stage from the next and formed with an inclined oval opening extending therethrough to provide undisturbed fluid flow between said stages;

a center plate interposed between said divider plate and the divider plate of the preceding stage and having a front surface and a rear surface;

a first recess formed in said rear surface of said center plate having a central portion shaped to mate with said impeller, a second portion extending radially outward from the exit portion of said impeller, a groove extending about the periphery of said second portion and gradually increasing in depth and width through approximately 360° and having a final curved portion formed to direct fluid flow through the oval opening in the subsequent divider plate; and a second recess formed in said front surface of said center plate having a curved portion formed to receive fluid flow from the oval opening in the preceding divider plate, a helical portion of substantially constant cross-sectional area spiralling inwardly through approximately 360°, and an axially diverting portion which continues to spiral inwardly through approximately another 360° while gradually deflecting the fluid flow axially rearward to deliver said fluid flow to the input of said impeller.

* * * * *